US006367264B1

(12) United States Patent
Tyree, Jr.

(10) Patent No.: US 6,367,264 B1
(45) Date of Patent: Apr. 9, 2002

(54) HYBRID LOW TEMPERATURE LIQUID CARBON DIOXIDE GROUND SUPPORT SYSTEM

(76) Inventor: Lewis Tyree, Jr., 115 Liberty Hall Rd., Lexington, VA (US) 24450

( * ) Notice: Subject to any disclaimer, the term of this patent is extended or adjusted under 35 U.S.C. 154(b) by 0 days.

(21) Appl. No.: 09/668,877

(22) Filed: Sep. 25, 2000

(51) Int. Cl.[7] ..... F17C 5/02
(52) U.S. Cl. ..... 62/47.1
(58) Field of Search ..... 62/47.1, 50.1, 62/376

(56) References Cited

U.S. PATENT DOCUMENTS

| | | | |
|---|---|---|---|
| 2,679,730 | A | 6/1954 | Kobold |
| 3,660,985 | A | 5/1972 | Tyree, Jr. |
| 3,672,181 | A | 6/1972 | Tyree, Jr. |
| 3,754,407 | A | 8/1973 | Tyree, Jr. |
| 4,100,759 | A | 7/1978 | Tyree, Jr. |
| 4,127,008 | A | 11/1978 | Tyree, Jr. |
| 4,211,085 | A | 7/1980 | Tyree, Jr. |
| 4,224,801 | A | 9/1980 | Tyree, Jr. |
| 4,510,760 | A | 4/1985 | Wieland |
| 4,693,737 | A | 9/1987 | Tyree, Jr. |
| 4,695,302 | A | 9/1987 | Tyree, Jr. |
| 4,886,534 | A | 12/1989 | Castan |
| 4,888,955 | A | 12/1989 | Tyree, Jr. et al. |
| 5,177,974 | A | 1/1993 | Uren et al. |
| 5,373,701 | A | 12/1994 | Siefering et al. |
| 5,934,095 | A | 8/1999 | Tyree, Jr. |

*Primary Examiner*—William Doerrler
*Assistant Examiner*—Malik N. Drake

(57) ABSTRACT

A refrigeration system to be located at carbon dioxide using locations for providing cooled or sub-cooled liquid carbon dioxide at temperatures as low as minus 65° F. to various liquid carbon dioxide dispensing/using devices. The system is capable of being added to virtually every type of carbon dioxide storage vessel used at customer sites, and is especially useful where relatively short carbon dioxide use periods are involved, as the hybrid refrigeration cycle utilizes the liquid carbon dioxide in the storage vessel as a rechargeable refrigeration sink.

27 Claims, 5 Drawing Sheets

HYBRID LOW TEMPERATURE LIQUID CARBON DIOXIDE GROUND SUPPORT SYSTEM

CROSS REFERENCE TO RELATED APPLICATIONS

Not applicable

STATEMENT OF FEDERALLY SPONSORED RESEARCH AND DEVELOPMENT

Not applicable

BACKGROUND

1. Field of Invention

This invention relates to the apparatus and methods suitable for liquid carbon dioxide storage and process systems typically located at customer or user sites which supply liquid carbon dioxide (CO2) to devices which then utilize the liquid CO2 so as to provide various refrigeration effects. Such systems, while they may have many other beneficial uses, are especially useful as ground support/filling apparatus for trucks or rail cars expending liquid carbon dioxide for in-transit cooling, or for devices for food chilling or freezing or for making dry ice.

2. Description of Prior Art

Solid carbon dioxide (dry ice) has long been used as an expendable refrigerant for many cooling applications because of its ease of application, its non-toxity, its very large refrigeration effect when subliming, its direct change to the gas phase and its desirable low range of refrigeration temperatures. Dry ice, at atmospheric pressure, sublimes at minus 110° F. and has a heat of sublimation (refrigeration) of 244 btu/lb. Initially, liquid CO2 typically was made at central manufacturing plants, converted to dry ice in the form of blocks and then transported to the customer or using sites, stored, then placed or mixed when and where cooling was desired. If CO2 vapor was desired for carbonation, the blocks were placed inside high pressure converters (about 1,000 psig) and allowed to warm to ambient temperature.

However, the inconvenience of handling dry ice and the attendant weight loss after purchase, but before use (which typically averaged 50%), caused the CO2 industry to change to liquid CO2 distribution and customer storage. The standard for the U.S. CO2 industry became about 0° F. liquid CO2 with an equilibrium pressure of about 300 psig for distribution and customer storage. This temperature was selected as one that could be maintained readily by small single stage, air cooled freon type refrigeration units adjacent to an insulated customer storage vessel, with the coils for cooling the CO2 located in the ullage space of the customer storage vessel; and all so that the maximum allowable working pressure (MAWP) of the vessel was not exceeded. If vapor was desired for carbonation, etc., it was piped direct from the vessel's ullage volume or for large users, a liquid CO2 vaporizer was utilized. If the CO2 was to be used for cooling, the liquid CO2 was piped directly from the customer storage vessel to the using device. Subsequently, about 10,000 such vessels with internal coils and attendant refrigeration units of various sizes have been installed within the United States. In addition, many variations of this arrangement have been produced. A fleet of liquid CO2 trucks are also in place to distribute liquid CO2, and liquid CO2 production plants typically produced liquid CO2 suitable in temperature and pressure to support this system. However, one lb. of liquid CO2 at these conditions converts to only about 0.47 lb. of dry ice, thus providing only a heat of sublimation (refrigeration) of about 115 btu per lb. of liquid CO2 used. During the conversion about 0.53 lb. of CO2 is released as vapor. Thus while the change from a dry ice distribution system to a liquid CO2 distribution system greatly reduced the losses of dry ice CO2 and eliminated the inconvenience of dry ice handling; the use of liquid CO2 for cooling applications imposed an undesirable CO2 loss. The steel chosen to fabricate the insulated storage vessel was chosen to be safe at low ambient temperatures and various insulations were used, including foam glass. More recently, vertical storage vessels with vacuum insulation are available, which typically do not contain internal coils, and which are suitable for temperatures as low as about minus 40° F., and are replacing the older vessels.

It was well known that lower temperature liquid CO2 produced a higher percentage of dry ice/cooling when used, thus came a trend to production and distribution of lower temperature liquid CO2, so as to better support dry ice/cooling applications. Accordingly, in many geographic areas, a temperature of minus 20° F. and 225 psig for liquid CO2 delivery became feasible. Virtually no changes in existing equipment was required to accommodate this lowered distribution temperature, and any vessel's refrigeration unit, while less required, were left in place because of vacation and other low or non-use periods. However, principally because of metal safety concerns for the storage vessels, distribution equipment, etc., to further reduce the liquid CO2's temperature at the production plant would require replacing much of the existing distribution equipment and customer storage vessels. At about minus 70° F., CO2 begins to form a solid, and thus cannot be readily transported as a liquid, but a minus 65° F. liquid produces about 0.57 lb. of dry ice, a conversion improvement of about 20%. It has been estimated that about 4,000 tons per day of liquid CO2 is used for cooling applications in the U.S., thus 800 tons per day could be saved if all could be cooled to minus 65° F. before use. Accordingly, a number of refrigeration devices have been developed to cool liquid CO2 at the final use location for a wide variety of applications. Examples are: U.S. Pat. No. 4,888,955 issued December, 1989 to the present inventor, et al; U.S. Pat. Nos. 3,660,985 issued May, 1972, 3,672,181 issued June, 1972, 3,754,407 issued August, 1973, 4,100,759 issued July, 1978, 4,127,008 issued November, 1978, 4,211,085 issued July, 1980, 4,224,801 issued September, 1980, 4,693,737 issued September, 1987, 4,695,302 issued September, 1987, and 5,934,095 issued August, 1999, all to the present inventor.

While cooling liquid CO2 to low temperatures may seem to be a straightforward mechanical refrigeration problem; the highly unusual nature of CO2 (especially the triple point occurring at useful temperature and pressures) combined with the problems in moving a liquid that becomes a solid if allowed to de-pressurize (even momentarily) below the triple point pressure, combined to prevent a totally satisfactory solution. Some of the specific problems unique to CO2 and thus the industry include the facts that: (1) flowing liquid CO2 when de-pressurized even momentarily to about 60 psig (the triple point), almost instantly becomes a mixture of liquid and solid and only changes back to liquid with the relatively slow application of heat; and (2) in any subsequent flow, this mixture easily clogs lines, valves and use devices as additional solid/slush CO2 forms, and any subsequent pressure reduction will cause it to turn progressively solid. Accordingly, most prior art inventions did not move very cold liquid CO2 to a use point, without providing subcooling with a pump or by some type of gas pressurization.

A related problem is due to the nature of use of most expendable refrigerants, of which CO2 is member, whether used in liquid form or in solid form (dry ice). Expendable refrigerants typically are used precisely when the cooling is desired and in the exact amount needed, thus the use rate can vary greatly. Low use rates can be followed by high use rates, varying quickly from no use to very high use. Patents '985, '407, '759, '085, '737, '302, '955, and '095 all solved the problem of when very cold liquid CO2 is being used, by incorporating a storage function of previously cooled liquid CO2 for supply to CO2 using/dispensing devices along with the storage of warmer liquid CO2; thus storing the cold liquid CO2 in the sub-cooled condition. However, none were versatile enough to find wide use.

While sought for years and despite all these efforts, a sufficiently versatile solution to have wide applicability has evaded the CO2 industry.

SUMMARY OF THE INVENTION

The present invention provides methods and systems for safely receiving liquid CO2 at a range of temperature and pressures into either an existing or a new customer located storage vessel that, by temperature and pressure manipulation, is subsequently able to increase the liquid CO2's refrigeration potential to the extent possible by cooling the liquid CO2 to between about minus 65° F. and about minus 30° F. prior to final use; and to maintain this liquid CO2 in the cooled and/or sub-cooled condition so it is available for ready flow to the use point without fear of dry ice blockages inadvertently occurring as it is being used. In one aspect, this hybrid system is able to incorporate use of the existing vessel refrigeration unit and standard events associated with distribution and use of liquid CO2 to simplify and minimize the size of the refrigeration equipment, without imposing the burden of discarding the existing equipment. It is modular, thus one or more of the system's components (and in different sizes) can be installed, as best fits the individual users needs and equipment availability. Apparatus for maximizing the existing storage vessel's (and its contents) potential refrigeration effect storage (thermal storage) for future utility is also included. In addition, in another aspect, the system is able to utilize the frequently largely unused, but already installed vessel refrigeration equipment. Accordingly, the modular system is able to be readily adapted to meet virtually all the different user's sizes and pattern of liquid CO2 use requirements, but without the burden of custom designed and engineered systems or special customer station vessels. Thus a simple, add-on type modular and versatile system is provided that inter-reacts with most existing liquid CO2 production, distribution and customer storage and refrigeration equipment, so as to provide more efficient conversion of liquid CO2 to a colder or sub-cooled condition for those users who benefit from such additional cooling and reducing CO2 use by about 20%. Accordingly, one important aspect of the invention is incorporation in the process tank of a separate storage function for the high refrigeration potential liquid CO2, and the liquid CO2 stored in this separate process tank can be maintained in the sub-cooled condition, ready for instant use without fear of blockages. Another aspect is that the colder and/or sub-cooled liquid CO2 systems are able to recharge the storage simultaneously while the storage is being drawn upon by customer use. Still another aspect is that a storage vessel pressure control management system is included. One special advantage is that the size and of the storage vessel and the size of the sump or processing tank are independent of each other; and the size of both the deep cooling equipment and storage vessel refrigeration unit(s) are also independent. This allows selection of the receiving storage vessel's size to include distribution economies; and selection of the processing tank's size, and selection of both the deep cooling equipment and storage vessel's refrigeration units' sizes to include individual user CO2 needs/use patterns. This added equipment can be located near the receiving vessel or in circumstances where the CO2 use point is elsewhere, located so as to minimize the distance the chilled CO2 is piped to use. In still another aspect, one refrigeration unit can be provided which alternately either acts as a chiller for the storage vessel, or acts as a hybrid or modified binary cascade low temperature chiller for the process vessel, having a thermal storage/flywheel feature associated with the CO2 portion of the hybrid cycle. If desired, the chilled CO2 can be maintained in the sub-cooled condition without the use of a pump, so the pressure drop associated with flow can be accomplished without the CO2 flashing to vapor and interfering with the flow of liquid, so to provide predictable flow characteristics.

BRIEF DESCRIPTION OF THE DRAWINGS

FIG. 5 is the system operating as a CO2 vapor condenser and chiller for the storage vessel. FIG. 6 is the same system, but operating as a low temperature chiller for liquid CO2 in the process tank.

Figure 1:
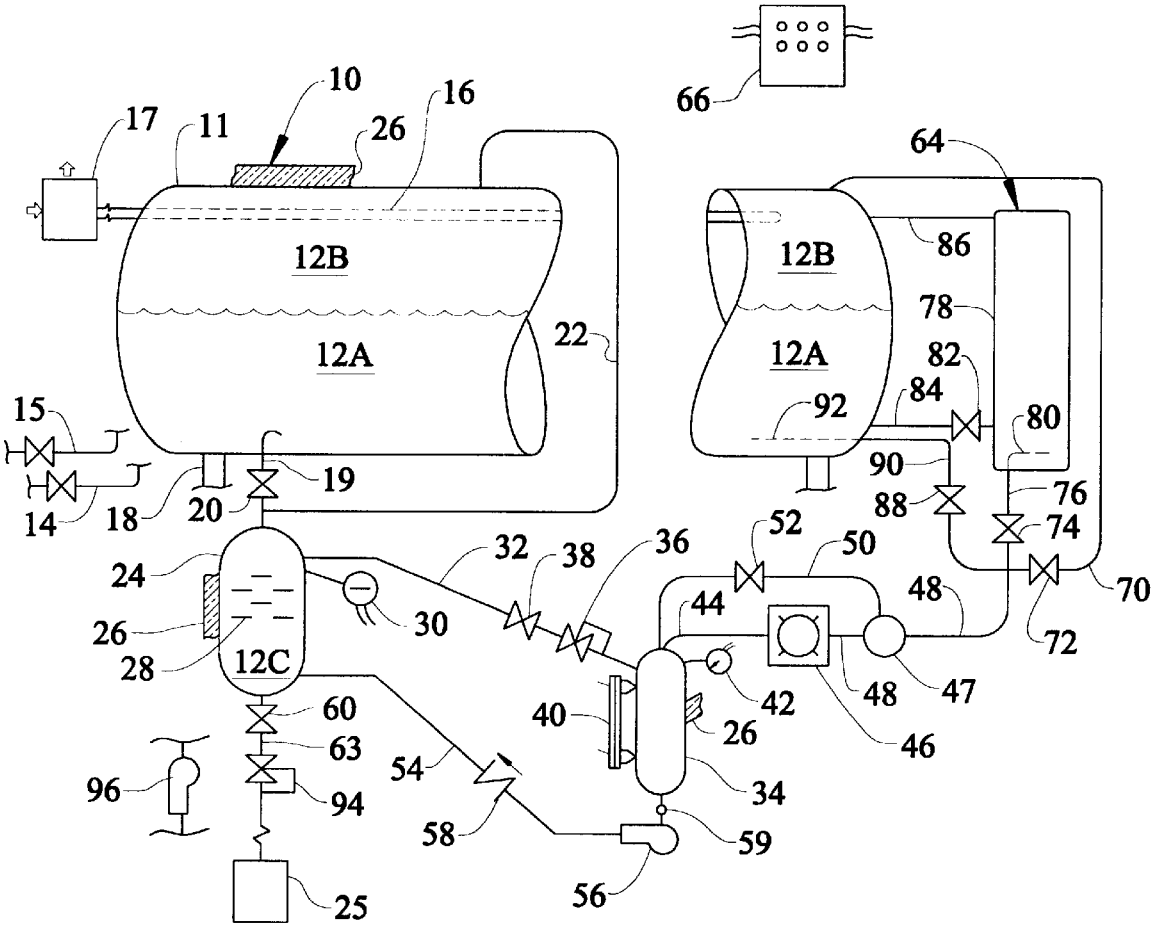
FIG. 1 is a diagramatic/schematic view of a system embodying various features of the invention with portions broken away and with a number of components shown schematically and the system components grouped by function. While the CO2 storage vessel is shown as horizontal, as horizontal vessels typically contain large refrigeration coils, it can be vertical. It has connections for filling and for use; and a mechanical refrigeration section having a closed cycle freon type refrigerant compressor, an air cooled refrigerant condenser and common controls, connecting with the refrigeration coils within the vessel condensing CO2 vapor, thus maintaining the pressure/equilibrium temperature in the storage vessel below the vessel's maximum allowable working pressure (MAWP). A smaller combination low temperature process and storage tank is depicted as located near the storage vessel, but could be located elsewhere if desired. A separate CO2 type low temperature refrigeration cycle system direct deep cools the liquid CO2 removed from the process tank and returns it in a sub-cooled condition, (which also serves as a reservoir of deep cooled liquid CO2, which is in the sub-cooled condition). Depending upon the pressures and temperatures involved, this second refrigeration system rejects part of its heat to the atmosphere, and part of its heat as CO2 vapor to the storage vessel using a pressure management system. This vapor can then be reliquefied by the vessel refrigeration system.

These elements in concert provide systems with an unusual ability to provide the various cooling/sub-cooling loads desired, and the use of modularity allows the ready provision of a system that meets the different needs of individual users. To better meet variable CO2 demands, the cooling/sub-cooling cycle incorporates a reservoir and storage tank, which accumulates a supply of cooled/sub-cooled liquid CO2, and which can be replenished concurrently with usage from it without warming the cooled/sub-cooled liquid CO2 already within the reservoir or storage tank. The size of this reservoir is independent of the other components of the system, therefore as one example, a relatively small process tank could be provided for refilling the about 1,000 lb. capacity liquid CO2 tank carried on each truck of a fleet of 15 trucks refilled over an 2 hour span, and a larger tank provided for filling all trucks or filling one railroad car bunker with about 10,000 lbs. of dry ice snow both within 20 minutes, with all the other system components the same. Note: In all drawings where CO2 flow is shown, a single headed arrow → indicates CO2 vapor flowing; a two headed arrow →→ indicates CO2 liquid flowing;

and a three headed arrow →→→ indicates very cold sub-cooled CO2 liquid flowing. A circle following the arrow -•-→ indicates a freon type refrigerant is flowing, with the other arrow designations similar.

Where the identical part appears in different Figures, or in variations of related embodiments (as FIGS. 1, 2, 3, & 4 as well as FIGS. 5, & 7) or the same embodiment but operating in a different mode (as FIGS. 5 and 6), the same reference character is used. Where the same part appears in different embodiments, a single primed reference character is used.

For the purpose of simplifying the Figures, some lines/connections to the vessels or tanks standardly provided in the CO2 refrigeration industry, as well as those used in freon type closed cycle refrigeration systems have been omitted, such as fill or transfer lines, auxiliary liquid or vapor lines, surge tanks, safety relief valves and burst discs, level/contents devices, pressure gauges, clean-out connections, and others. System monitoring devices, controls and programmers are included as desired. Valves can be electric, pneumatic, other, remotely controlled or manual.

DETAILED DESCRIPTION OF THE PREFERRED EMBODIMENTS

Illustrated in FIGS. 1, 2, 3, 4, 5, 6, and 7 are embodiments and variations thereof of a system to be located at a liquid CO2 users site for delivering very cold, sub-cooled if desired, liquid CO2 to various types of CO2 dispensing devices; at selected temperatures (between about minus 65° F. and about minus 300° F.), and at selected pressures (between about 65 psig and about 500 psig). It is useful with both horizontal liquid CO2 storage vessels, typically having large internal refrigeration coils; and also with vertical vessels, typically having small or nonexistent internal refrigeration coils. It includes methods of using any liquid CO2 in the storage vessel as a means of providing thermal storage to be subsequently utilized to help create very cold and/or sub-cooled liquid CO2 during periods of heavy use; and also provides a separate reservoir of very cold and/or sub-cooled liquid CO2 so as to further assist the system in meeting periods of heavy use.

Figure 2:
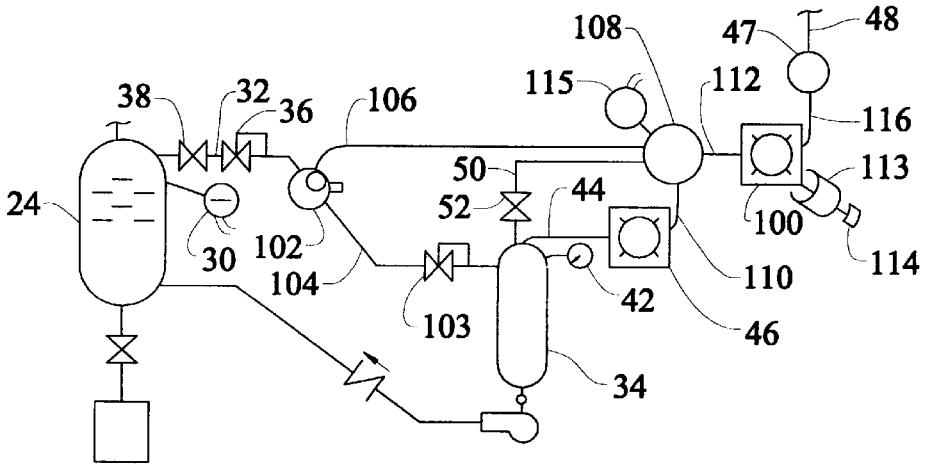
FIG. 2 is the systems of FIG. 1, except that the single liquid CO2 expansion and vapor CO2 compression portion is replaced with a multiple expansion and vapor compression portion.
Figure 3:
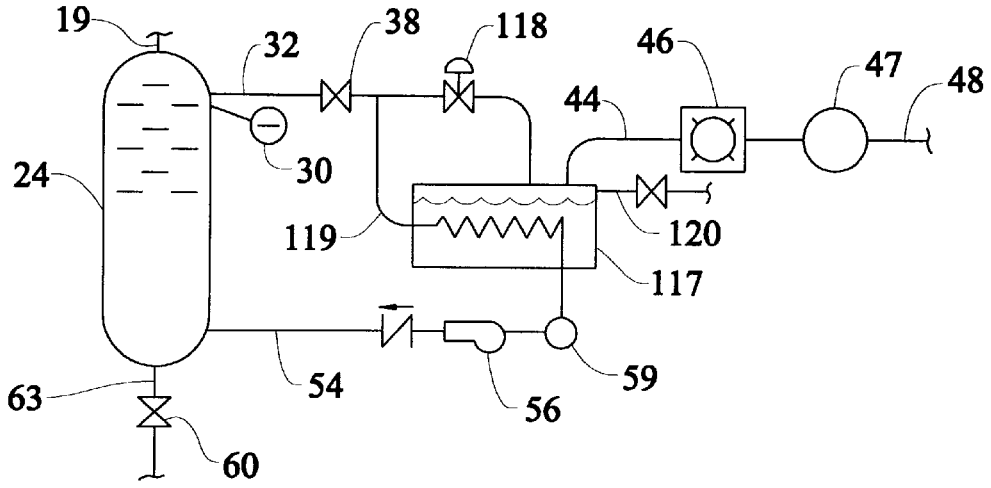
FIG. 3 is a similar system to either FIGS. 1 or 2, except that the low temperature CO2 refrigeration, semi-open cycle system indirectly deep cools in a heat exchanger the liquid CO2 from the combination storage and process tank before returning it in the sub-cooled condition.

Illustrated in FIGS. 1, 2 and 3 is the system with a CO2 lower stage refrigeration system, rejecting its heat to an upper stage freon type mechanical system which condenses CO2 vapor within the storage vessel and is able to cool its CO2 contents, enabling the contents to act as an inter-stage thermal flywheel. This allows the CO2 lower stage to reject heat (cool) at a very high rate. This binary refrigeration combination is referred to by some as a hybrid system. The cycle illustrated in FIG. 2 is commonly referred to as a CO2 bleeder cycle, which greatly reduces the demand on the CO2 compression system by utilizing multi-staging and split flows of compressors. Moreover, to best utilize the thermal storage potential of the storage vessel, its liquid CO2 contents and any companion refrigeration system; a return CO2 vapor pressure management system can be provided. Normally, there will little or no use of liquid CO2 from the system at night. Accordingly, the vessel refrigeration system (s) can progressively reduce the temperature of the liquid CO2 within the storage vessel and thereby both increase the thermal storage potential and reduce the cooling needed when the liquid CO2 is being deep chilled. One feature of the pressure management system is the CO2 vapor being returned to the vessel by the CO2 refrigeration cycle is returned to the vessel's ullage volume, thereby not warming the liquid CO2 previously cooled within the vessel. Another feature of the pressure management system is provision so that the condensing coils operate more efficiently by having the CO2 vapor they are condensing saturated (or near saturated), so that de-superheating of the CO2 vapor does not have to occur prior to condensation by the coils. Still another feature of the pressure management system is that is the vessel pressure approaches the MAWP, the vapor being returned passes through the cooled liquid, thereby decreasing the refrigeration load on the vessel refrigeration system. All is especially useful for coil-in-vessel systems.

Turning first to FIG. 1, depicting five semi-independent groupings of apparatus connected so as to form one variation of this system/invention. Storage vessel system 10 contains an inner vessel 11, which is filled with liquid CO2 12A from a delivery vehicle (not shown) through liquid fill line 14, with a fill-vapor return line 15 relieving excess pressure occurring during filling back to the delivery vehicle, and thus returning CO2 vapor 12B from the top/ullage volume of the inner vessel 11 to the vehicle. Vapor CO2 12B will then return to the shipping point via the vehicle for disposal or re-liquefication. This returned vapor represents a refrigeration load removed from system 10. Fill line 14 can be divided into sub lines as desired, i.e. one to the top and one to the bottom of inner vessel 11 as well as one or more intermediate entry lines if provided on the vessel (not shown), so as to provide for ease of filling and control of temperature/pressure of the liquid CO2 12A in the inner vessel 11 during filling operations. Refrigeration coil 16 is located within the ullage volume of vessel 11 and connected to the second apparatus grouping, appropriately sized refrigeration unit 17. If two coils 16 are provided within the vessel (or provision for such), then two units 17 can be utilized. System 10 is supported upon legs 18. A liquid withdrawal line 19 with valve 20 and branch line 22 is provided for filling the third apparatus grouping, containing the low temperature combination storage/process tank 24 through its upper portion. Tank 24 can be located near system 10, so as to simplify and minimize the piping between system 10 and itself and promote the ready flow of liquid CO2 12A from vessel 11 to and through tank 24 (where it becomes cooled/sub-cooled liquid CO2 12C) to the using device 25. Alternately, tank 24 can be located near device 25. Tank 24 can be of any desired size, as it also serves as a storage reservoir, in use supplementing the low temperature refrigeration system's output. Branch line 22 connects the top of tank 24 to the top of vessel 11 in such a manner that when valve 20 is opened, liquid CO2 12A flows from the lower liquid space of inner vessel 11 through line 19 into the upper volume of tank 24, and any vapor 12B flows into the upper or ullage volume of vessel 11. A safety relief line, having a number of safety related functions connects to the top of inner vessel 11 and a similar function line connects to the top of tank 24 (not shown). An automatic blow-back system, of the type common in the cryogenic industry (for returning any liquid CO2 trapped in tank 24 to vessel 11 when valve 20 is closed), can be provided (not shown). All vessels, tanks, valves, and lines etc. that operate at below ambient temperatures have suitable insulation 26. If desired, anti-mixing devices 28 are located inside tank 24 so as to promote stratification. Temperature sensor 30 is inserted into tank 24.

The fourth apparatus grouping consists of the low temperature portion of the hybrid refrigeration system. Vapor withdrawal line 32 connects the upper volume of tank 24 to evaporative cooling tank 34 and includes pressure regulator 36, valve 38 and insulation 26. Tank 34 includes a two position level control 40 and a pressure switch 42. Line 44 connects the top of tank 34 to compressor 46 which discharges to and through receiver 47 via line 48. Line 50 connects receiver 47 with the top of tank 34 and contains valve 52. Cooled liquid CO2 12C transfer line 54 connects the bottom of tank 34 to the bottom of process tank 24 and contains pump 56 and check valve 58. Any NPSH required by the pump, if and when needed, can be provided by opening valve 52 to the extent required, thus admitting CO2 vapor through line 50. Liquid CO2 12A can thus be removed from the upper portion of tank 24, moved to tank 34, deep cooled to condition 12C, at a temperature between about minus 30° F. and about minus 65° F. in tank 34 and returned to the bottom of tank 24 in batch cycles, as controlled by level control 40, switch 42, and sensor 30, after passing through condenseable contaminants separator 59. Non-condenseable contaminants can be purged or used for pneumatic valve operation or vented (not shown). Should they be required, the optional anti-mixing devices 28 (located at different levels in tank 24) or low velocity entrance arrangements (not shown) maintain the separation between the colder liquid CO2 12C and the warmer liquid CO2 12A wherever the thermocline occurs in tank 24 when liquid CO2 12A or liquid CO2 12C enter tank 24 during use. Valve 60 located in line 63 controls the flow of cold/sub-cooled CO2 12C from tank 24 to using device 25. Line 63 can have a pressure sensing and purge control system to prevent formation of dry ice therein or within device 25, when valve 60 is opened, as used within the CO2 industry (not shown).

The fifth apparatus grouping, comprises the pressure management system 64, especially useful when system 10 includes one or more internal coil 16 and large refrigeration unit 17, but whose use is optional, and whose function will be described later in detail. By the use of this arrangement, CO2 vapor can be withdrawn from the process tank 34, raised in pressure by compressor 46, and then returned to the inner vessel 11, all as determined by the logic of the process controls 66.

In addition, controls 66 monitors and controls the various elements of the entire system, in a manner compatible with the needs of device 25, the anticipated use cycle, and the capabilities of the individual elements of the entire system.

While compressor 46 has been depicted as a non-lubricated (oil-less) rotary vane compressor, any suitable type can be utilized; and all control devices and sensors could be replaced with other types, such as electronic. Filters, vents, purge valves, clean-out arrangements, and other details surge tanks and many other items normal to the CO2 industry, the CO2 refrigeration industry, and to the freon refrigeration industry can also be included as desired.

Illustrated in FIG. 1 (as well as in FIGS. 2, 3, 4, 5, 6 and 7) are systems to be installed at a user's site for delivering very cold/sub-cooled liquid carbon dioxide to various types of dispensing/using devices, at selected temperatures (usually between about minus 30° F. and about minus 65° F.) and at selected pressures (usually between about 65 psig and about 500 psig). They are useful with both horizontal and with vertical liquid carbon dioxide storage vessels, those with large, medium, small or non-existent refrigeration coils. All include a method of using the liquid carbon dioxide within the storage vessel as a means of providing thermal storage (or equivalent) to be utilized to create very cold/sub-cooled liquid carbon dioxide during periods of heavy use; and also provides a reservoir of very cold/sub-cooled liquid carbon dioxide so as to further assist in meeting heavy use demands. These embodiments provide a system with an unusual ability to follow the various cooling loads required, and the use of modular elements allow the provision of systems that can be sized to meet use demands from small to very large.

Referring to FIGS. 1, 2, 3 & 4, and specifically to line 48 of FIG. 1 containing carbon dioxide vapor 12C which is to be returned to vessel 11, system 64 provides versatility as to the various flow paths/entrances of this vapor into vessel 11. This allows maximizing the benefits of the specific equipment, while allowing and providing for the differences in optimum characteristics of individual dispensing/using devices 25.

The function of the vessel pressure management system 64 is best understood if an example is given. This system maximizes all the refrigeration capabilities related to vessel system 10, including control of vessel 11's pressure to secure desirable liquid carbon dioxide pressure being supplied to dispensing/using device 25 just prior to and during on-use periods; and control (lower) the temperature of the liquid carbon oxide 12A stored in vessel 11 during off-use periods, so as to both reduce the amount of cooling subsequently required to produce the desired sub-cooled carbon dioxide, and increase the thermal storage potential of liquid CO2 12A within vessel 11, all as explained later. For this example, it is assumed that the Maximum Allowable Working Pressure (MAWP) of the vessel 11 is 350 psig and the minimum safe temperature at that pressure is minus 20° F. Tank 24 is constructed so as to be safe at least about minus 70° F. and about 350 psig (lower or higher pressures are possible if provided for). Deliveries of liquid carbon dioxide into system 10 typically can range between about 225 psig and 300 psig equilibrium pressure. The equilibrium pressure-temperature relationship of liquid carbon dioxide at various intermediate conditions are as follows:

| pressure, psig | | temperature ° F. |
|---|---|---|
| 350 | | +8 |
| 300 | | +2 |
| 250 | | −8 |
| 125 | | −42 |
| 80 | | −60 |
| 60 | Triple Point | −70 |

Control panel 66 monitors the pressure in vessel 11 and at the appropriate times cause the respective elements of the vessel pressure management system 64 to function. For the purposes of this example, it is assumed that either the bunker of a very small rail car, container or truck is being filled with snow (with a desired filling time of 1 hour), minimum pressure of 300 psig is desired during such use; or a number of small liquid tanks carried on trucks for later use in providing cooling. It is also assumed that liquid carbon dioxide use by these examples only occurs between about 8 am and about 6 pm. Also normal liquid carbon dioxide truck/rail delivery pressure into system 10 is 250 psig.

Accordingly at about 7:30 am, the pressure in vessel 11 could be about 250 psig, either from a delivery or from the action of refrigeration unit(s) 17. Initially, controls 66 cause the low temperature refrigeration system to operate so tank 24 becomes full of sub-cooled liquid carbon dioxide 12C. Compressor 46 begins to operate so as to remove the evolving carbon dioxide vapor, and compressed carbon dioxide vapor begins to flow through line 48. Controls 66 determines that the vapor should flow through line 70 directly to the top/ullage volume of vessel 11 so as to raise the vessel pressure to the desired about 300 psig as rapidly as possible and accordingly opens valve 72 so that the carbon dioxide vapor 12B flows directly to the ullage volume of vessel 11 through line 70, until at least the desired minimum pressure of about 300 psig is reached. At the same time, refrigeration unit(s) 17 are not allowed to operate until the pressure of vessel 11 reaches about 300 psig, all so unit(s) 17 operate in a more efficient range. If the pressure of vessel 11 rises to about 320 psig, valve 72 is closed and valve 74 is opened and the carbon dioxide vapor now flows through line 76 into saturater/de-superheater 78. As the vapor flows into saturater/de-superheater 78, injector 80 causes it to bubble through liquid carbon dioxide 12A admitted from vessel 11 by valve 82 opening line 84. After bubbling through liquid carbon dioxide 12A, the CO2 vapor 12B becomes cooled and de-superheated, and then passes (along with the vapor evolving from the liquid carbon dioxide 12A vaporized in the process) to vessel 11 through line 86 where it can be condensed by coil(s) 16 and refrigeration unit(s) 17. However, by these means, the bulk temperature of liquid carbon dioxide 12A in vessel 11 remains essentially unchanged. The capacity of coil(s) 16 is greater if the carbon dioxide vapor 12B they are condensing is already saturated, effectively raising the capacity of refrigeration unit(s) 17. As the pressure in vessel 11 raises, the capacity of refrigeration unit(s) 17 progressively increases, due to the coils condensing at a warmer temperature and the suction pressure of refrigeration unit(s) 17 becoming correspondingly higher. In addition, as the carbon dioxide vapor 12B flows into the ullage volume of vessel 11 at increasing pressures, that volume accepts and stores that vapor for later condensation, effectively adding to the thermal storage potentials of the system.

If the pressure of vessel 11 drops below 310 psig, the refrigeration unit(s) 17 can be stopped. Cycling of these different elements continues as required. Should the pressure in vessel 11 raise to about 325 psig (about 5° F. equilibrium temperature), valves 74 and 82 will be closed and valve 88 opened, which then allows the vapor to flow directly into the vessel 11 through line 90 to optional sparger 92. Since the body of liquid carbon dioxide 12A in vessel 11 could be at as low a temperature as about minus 8° F., the amount of vapor 12B now reaching the ullage volume will be reduced by the amount of condensation taking place in the liquid 12A. This vapor is also de-superheated. This method uses the sub-cooled condition of the liquid carbon dioxide 12A as a thermal storage medium, so as to reduce the refrigeration load on unit(s) 17. As the pressure in vessel 11 changes due to the use circumstances and other events effecting system 10, control 66 opens or closes valves 72, 74, and 88 appropriately. The system typically is able to follow the use pattern of liquid carbon dioxide 12C supplied to the dispensing/using device 25 without venting of carbon dioxide vapor by maximizing the refrigeration capacity of refrigeration unit(s) 17 and coil(s) 16, and the thermal storage capabilities of the liquid carbon dioxide 12A in vessel 11 and the equivalent thermal storage capability of vessel 11's ullage volume.

A separate arrangement (not shown) would be to have the deep cooling systems reduce the temperature of the liquid carbon dioxide 12A in the vessel 11 at night, to the extent safely allowed by the materials of construction of vessel 11 (construction and materials of vessels can differ and about a minus 40° F. capability can be found) by providing a branch line from pump 56 back to the lower portion of vessel 11, and the use of appropriate control settings. This would have the result of increasing the capacity of the system for providing sub-cooled liquid carbon dioxide when later needed by reducing the amount of cooling required and also increasing the thermal storage potential of the liquid carbon dioxide 12A within vessel 11, as will be explained later. Should a lower pressure for liquid carbon dioxide 12C be desired at device 25, optional pressure regulator 94 can be located in line 63. Conversely, should a higher pressure be desired, optional pump 96 can be located in line 63. Should a lower pressure be desired in tank 24, an optional pressure regulator can be located in line 19, downstream of line 22 (not shown).

Turning next to FIG. 2, we turn to the operation of tank 24 and tank 34 when a bleeder type expansion and vapor carbon dioxide refrigeration cycle is employed, utilizing a second compressor 100 which is in series with the first compressor 46. While this arrangement is shown with two compressors, additional compressors (and additional stages) could be employed. Following regulator 36 in line 32, vapor-liquid separator 102 is added along with regulator 103 in line 104 (which connects the liquid outlet of separator 102 and tank 34). Line 106 connects the vapor outlet of separator 102 with interstage receiver 108. Line 110 connects the discharge of compressor 46 with receiver 108. Line 112 connects receiver 108 with the inlet of compressor 100. Motor 113, (with variable speed control 114, responding to the intermediate stage pressure(s) caused by changes in flash gas amounts if the temperature of the liquid carbon dioxide 12A changes, and pressures sensor 115, speeding up or slowing down motor 113 appropriately, if desired), drives compressor 100. Line 116 connects the discharge of compressor 100 with receiver 47 and line 48, and with the remainder of the system, all as in FIG. 1. The action of this variation is similar to that in FIG. 1, and continues operation until temperature sensor 30 senses that tank 24 is full of cold liquid carbon dioxide 12C. This use of two or more compressors greatly increases the deep cooling capacity of this embodiment.

The approximate cooling capacity of these three refrigeration elements (refrigeration unit(s) 17, thermal storage of liquid 12A in vessel 11, and vapor 12B acceptance into the ullage volume of vessel 11) for a standard 30 ton customer vessel with provision for two (2) refrigeration units is as follows:

(a) for eight (8) horsepower freon refrigeration unit(s) 17, as used in the CO2 industry, in lbs./hour of sub-cooled (about minus 60° F.) liquid 12C; ten (10) horsepower units 17 have approx. ⅓ more cooling ability);

| one (1) unit | two (2) units |
|---|---|
| 1,500. | 3,000. |

(b) for a standard 30 ton capacity horizontal customer vessel, as used in the CO2 industry, and depending upon the amount of liquid 12A in the vessel at time of use to supply liquid 12C, in lbs./day cycles:

| vessel 11 contents-12A | liquid 12A warming | vapor 12B acceptance | total |
|---|---|---|---|
| ¼ full | 1,700. | 1,700. | 3,400. |
| ½ full | 3,400. | 1,100. | 4,500. |
| ¾ full | 5,000. | 500. | 5,500. |

From the above, it is clear that the different factors can change in relationship, but that each is important. This example, while specifically relating to FIG. 2, applies to the concept of all the other embodiments.

Turning next to FIG. 3, the low temperature refrigeration apparatus is changed in that the carbon dioxide deep cool cycle creates the sub-cooled liquid carbon dioxide by using a heat exchanger, rather than by the direct self-cooling of FIGS. 1 and 2 (de-pressurizing the liquid carbon dioxide, then re-pressurizing it). A standard type evaporator-cooler 117 replaces cooling tank 34 of FIGS. 1 & 2. Line 32, connected to tank 24, branches just after valve 38, with one branch containing expansion valve 118, which provides low pressure liquid carbon dioxide which cools the liquid carbon dioxide in the second branch line 119 as it passes through the heat exchanger portion of cooler 117 (and separator 59) as influenced by pump 56. Inasmuch as the liquid carbon dioxide is sub-cooled when it reaches pump 56, line 50 and valve 52 of FIG. 2 are not required. The resultant carbon dioxide vapor leaves exchanger cooler 117 by line 44, and is compressed and returned to vessel 11 in the same manner as in FIG. 1 (or if a bleeder expansion arrangement is used, in the same manner as in FIG. 2). A variety of controls are suitable; one such shown as having expansion valve 118 controlled by a liquid level sensor (not shown) located in exchanger 117 (flooded type), compressor 46 controlled by pressure switch 42 (not shown), and pump 56 controlled by temperature sensor 30. A blow-down line 120 is provided so as to periodically discharge from the system any accumulated non-condensable impurities, such as air etc. One advantage of this embodiment is any impurities, condensable or non-condensable, which are in the liquid carbon dioxide when it is delivered to system 10 are eliminated, when and where they are most likely to be formed.

Figure 4:
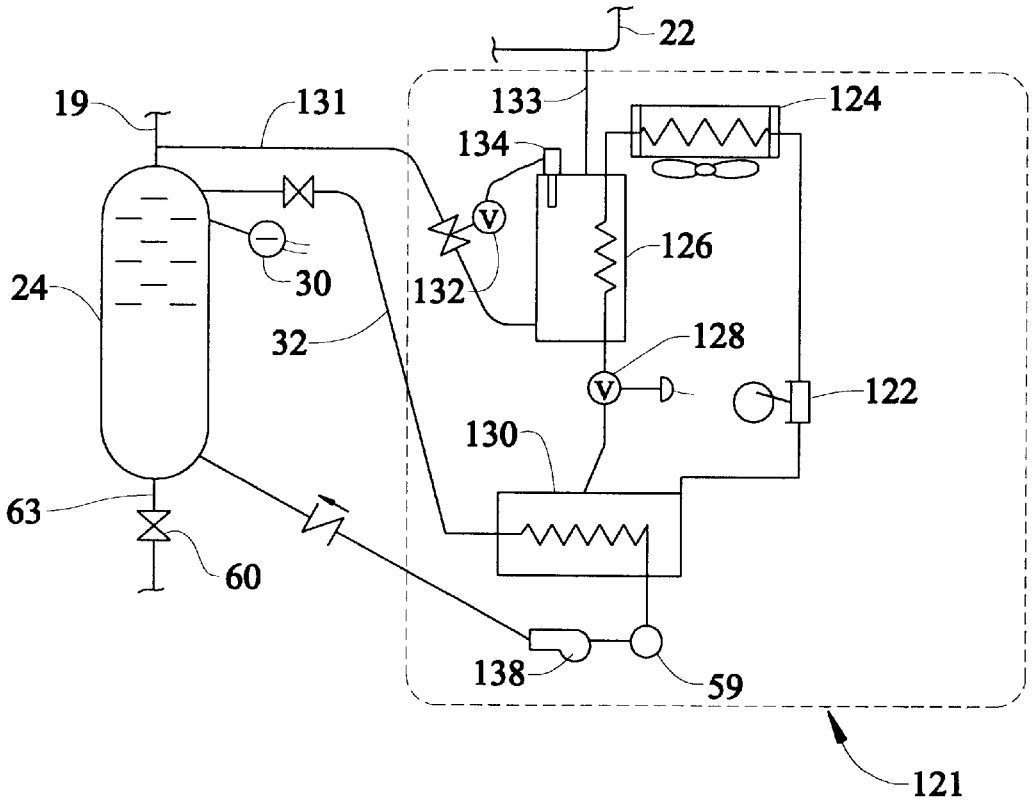
FIG. 4 is a similar system to that in FIG. 1, except that the low temperature CO2 refrigeration semi-open cycle system is replaced with an alternate low temperature system; a compound closed cycle mechanical refrigeration unit using a suitable low temperature refrigerant (such as R-502, R-404A or other), rejecting part of its heat to the atmosphere and part as CO2 vapor back to the storage vessel.

Turning next to FIG. 4, the low temperature refrigeration apparatus of FIGS. 1, 2, & 3 is replaced with a different type and pressure management system 64 is removed, as the carbon dioxide vapor returning to vessel 11 is not under sufficient pressure to manipulate and can be arranged to already be saturated (not shown). A combination or hybrid freon (a low temperature freon such as R-502, R-404A or other suitable refrigerant) and carbon dioxide refrigeration system 121 consists of a freon compressor 122, a freon condenser 124 (illustrated as operating against ambient air, although water or any other condensing agent could be used), a freon sub-cooler 126 (utilizing liquid carbon dioxide for sub-cooling), freon expansion valve 128 and freon evaporator/chiller 130 (also deep cooling liquid carbon dioxide). As compressor 122 must handle intake pressures of the refrigerant at the equilibrium pressure in the range of about minus 60° F. and discharge pressures at the-equilibrium pressure in the range of about 100° F.; compressor 122 must be capable of at least about 10 compression ratios and capable of operating at vacuum or near vacuum intake conditions. Very low temperatures are possible in the evaporator as the sub-cooler 126 cools the freon (or other refrigerant) to about 0° F. (the nominal temperature of liquid carbon dioxide 12A in vessel 11) before freon expansion in valve 128. Without this sub-cooling the deep cooling capacity of system 121 would be small. Line 19 and line 131 supply the liquid carbon dioxide 12A from vessel 11, with the flow controlled by valve 132 (carbon dioxide vapor from sub-cooler 126 returns to the ullage volume of vessel 11 through line 133 and line 22) responding to level control 134, making certain the freon sub-cooler 126 functions properly (other arrangements are possible, but not shown). Line 32 brings liquid carbon dioxide 12A from tank 24 to evaporator 130, as circulated by pump 138, being sub-cooled as it passes through evaporator 130. Pump 138 is driven by motor (not shown) which operates when control 30 calls for cooling. Capacity (temperature of exiting deep cooled liquid carbon dioxide) of pump 138 is matched to the capacity of heat exchanger 130 to deep cool liquid carbon dioxide from tank 24 by changing the speed of motor (not shown) or other means. This arrangement is as capable of producing about as low a temperature sub-cooled liquid carbon dioxide 12C as is those in FIGS. 1, 2 & 3, but it rejects part of its heat to the atmosphere directly (condenser 124) and part back to vessel 11. Accordingly, one desirable use is where the size or number of unit(s) 17 are limited. One such frequent case is with vertical vessels, having only limited sized coils 16 and resultant refrigeration unit(s) 17. While refrigeration system 121 is shown as a compound freon w/carbon dioxide sub-cooling, other types of low temperature refrigeration systems can be used.

Figure 5:
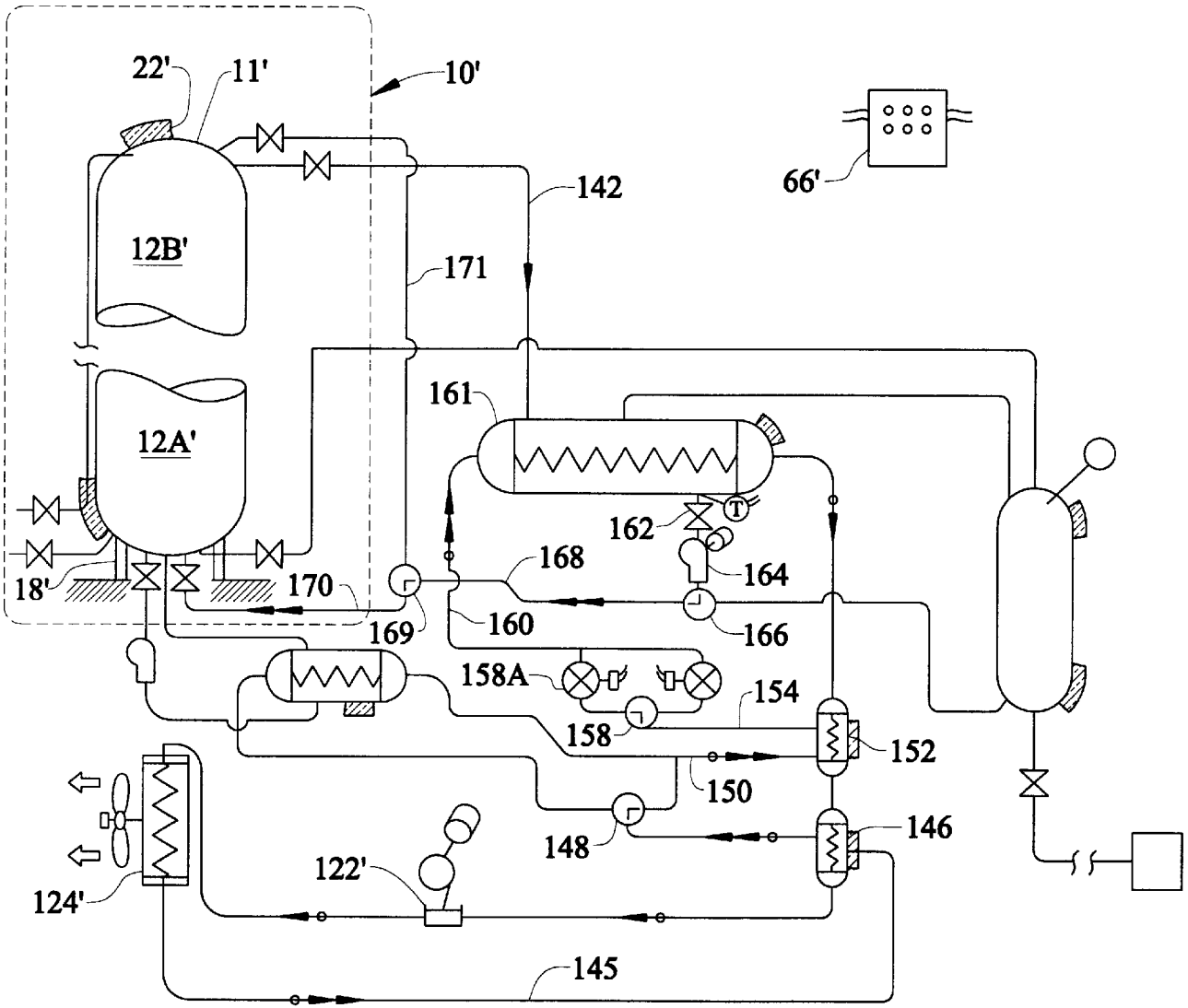
FIGS. 5 and 6 show identical refrigeration apparatus and liquid CO2 storage apparatus, but each show the system operating in a different node. This embodiment is particularly useful with either horizontal or vertical customer vessels with no or limited internal refrigeration coils.
Figure 6:
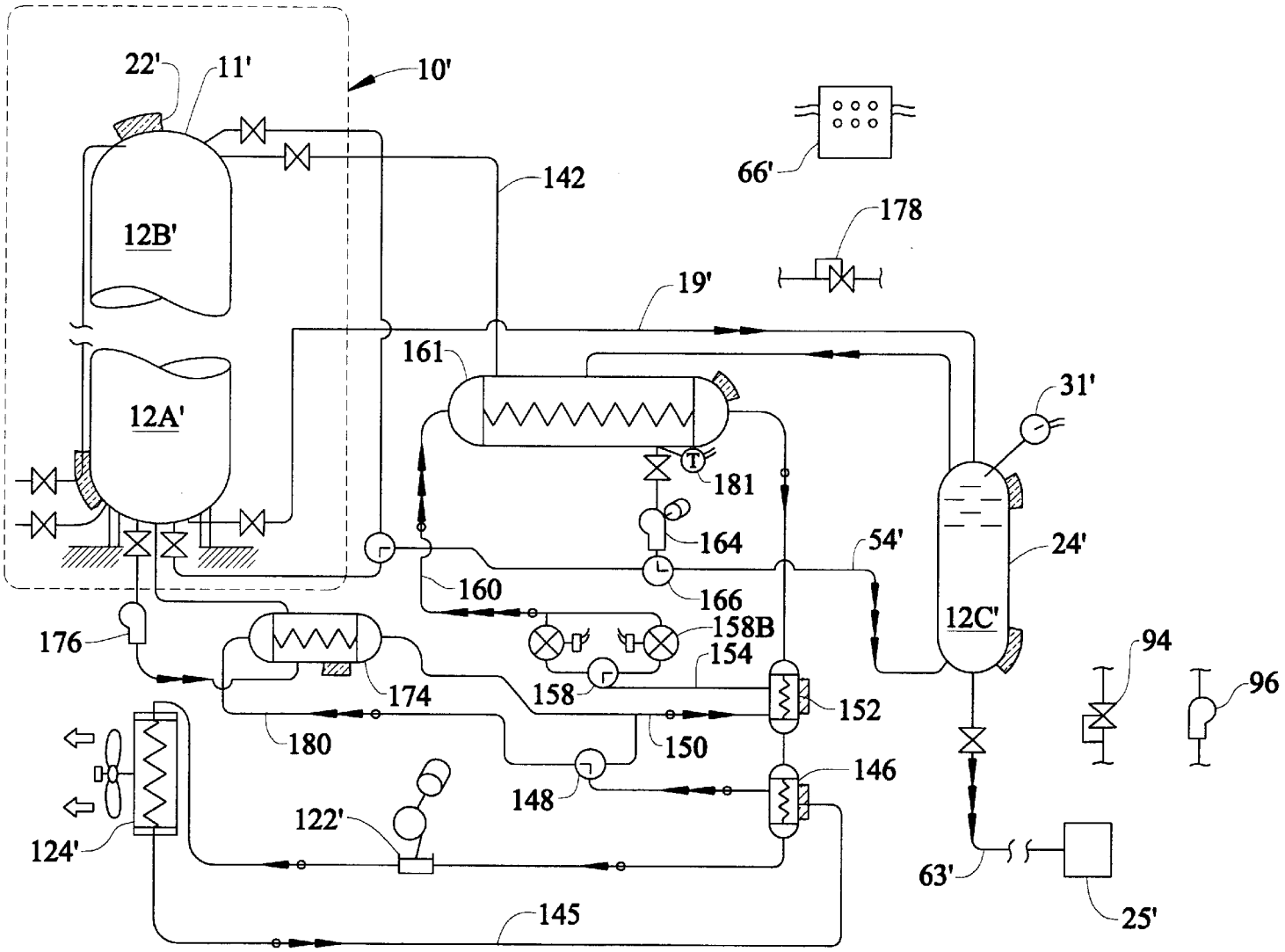
Figure 7:
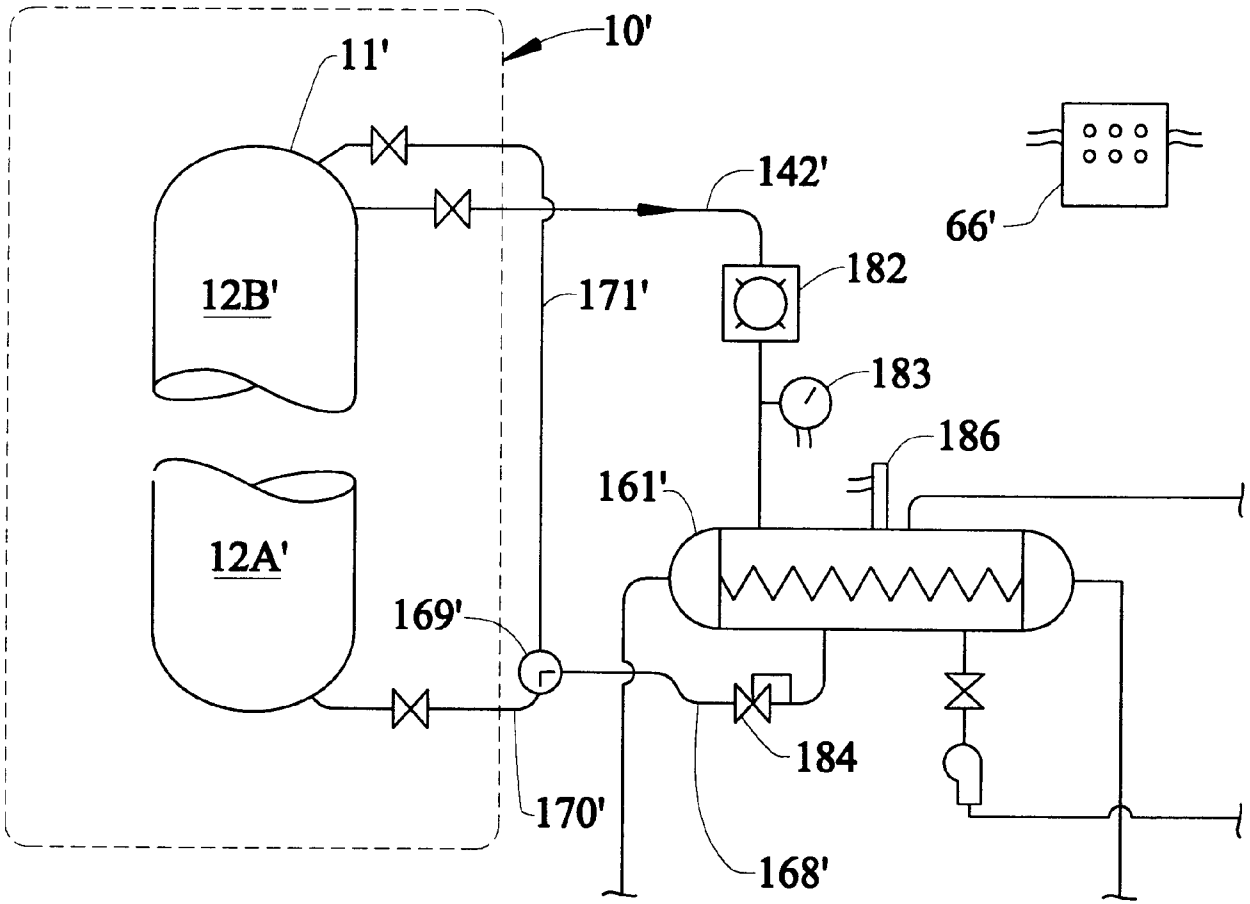
FIG. 7 is a variation of FIG. 5, but with an added CO2 vapor compressor to remove vapor from the vessel, and with associated controls, useful for providing added refrigeration to the storage vessel when in that mode of operation; and able to further lower the temperature of the liquid CO2 stored there.

Illustrated in FIGS. 5, 6, and 7 is a different embodiment of the invention, comprising a modified freon type closed cycle which operates at two different temperature levels; one about minus 10° F. and the other about minus 65° F. It achieves very low temperatures by first rejecting its heat of condensation to the atmosphere and then sub-cooling the now liquid freon with liquid carbon dioxide before expansion.

These embodiments depict a vertical storage vessel without an internal refrigeration coil(s) or associated refrigeration unit(s); as this embodiment is especially useful in such circumstances (although useful with horizontal storage vessels). The modified hybrid refrigeration system is able to serve as a vessel refrigeration unit or alternately as a deep chiller, depending upon the method desired at the time. FIG. 5 depicts the system when operating as a vessel chiller, with the flows of both CO2 and freon shown by appropriate use of arrow symbols. FIG. 6 depicts the identical system when operating as a deep chiller with very cold/sub-cooled liquid CO2 being supplied to a using device, and with the flows of both CO2 and freon shown by appropriate use of arrows and symbols. FIG. 7 depicts a CO2 vapor compressor added so as to enhance the performance of the system when operating as a vessel chiller.

The operation of the invention as depicted in FIG. 5 is where by removal of vapor 12B' from vessel 11', liquefying this vapor and returning it to vessel 11', both the temperature and pressure of liquid 12A' is reduced. This feature has various benefits: one being to maintain the pressure in vessel 11' during periods of non-use so as to prevent venting; another by reducing the temperature of liquid 12A' to increase the thermal storage potential of that liquid; and still another to reduce the amount of cooling required to cool liquid 12A' to the lower temperature of liquid 12C'. System 10' is depicted as vertical and without internal refrigeration coils (16 in FIG. 1), but could contain such. Inner vessel 11' contains liquid CO2 12A' and vapor CO2 12B' in the ullage volume. Liquid 12A' is withdrawn for use through line 19', as shown in FIG. 6. Insulation 22' suitably surrounds various elements of the invention.

In operation, panel 66' causes compressor 122' to circulate a suitable freon type refrigerant, where it is condensed by condenser 124' and thence by line 145 to suction heat exchanger 146 and to three way valve 148, set in this mode to connect to line 150. Line 150 connects to suction heat exchanger 152, where after further cooling, the refrigerant flows by line 154 to three way valve 156 and thence to expansion valve 158A, set for operation at about minus 100° F. The now cooled refrigerant flows through line 160 to evaporator 161 and returns to compressor 122, passing through exchangers 152 and 146 enroute. During this time, vapor CO2 12B ' flows through line 142 to be condensed in evaporator 161. After condensation to liquid CO2 18A', it flows through line 162 to pump 164 and thence to three way valve 166, set in this mode to connect to line 168, which in turn connects to three way valve 169, set in this case to return liquid CO2 12A' to the lower portion of vessel 11' by line 170. (optionally it could be returned by line 171 to the upper part of vessel 11', by reversing the setting of valve 169). All as controlled by panel 66', so that the refrigeration system operates as a storage vessel refrigeration unit.

The operation of the invention as depicted in FIG. 6 is an alternate use of the refrigeration system of FIG. 5, and where liquid CO2 12A' is being supplied as deep cooled and/or sub-cooled liquid CO2 12C' to dispensing device 25'; having passed through tank 24', which both stores liquid CO2 12C' and acts as a process tank for cooling liquid CO2 12A' to the temperature of liquid 12C'. The operation of the low temperature refrigeration system is changed so that the temperature level achieved is much lower, about minus 65° F.; by use of a refrigerant sub-cooler 174 and pump 176, which takes liquid CO2 12' from vessel 11' and circulates it back to vessel 11' as at least partly vapor 12B' (a compressor system could alternately be used, but not shown). This method uses the thermal storage potential of the liquid CO2 12A' in vessel 11' for sub-cooling the freon. For this example, we will assume that device 25' is in use (filling a small CO2 tank-not shown) and liquid CO2 12C' is being supplied in a cooled/sub-cooled condition of about minus 65° F. and about 125 psig. As liquid CO2 12C' leaves tank 24', warmer replacement liquid CO2 12A' is drawn in through line 19' from vessel 11'. Temperature sensor 31' causes the refrigeration system to operate (or continue to operate) so as to bring liquid CO2 12A' then within tank 24' to the desired low temperature. Pressure regulator 178 can be installed in line 19', should the MAWP of tank 24' be less than that of vessel 11', and can also be installed in line 63' to limit the pressure of liquid CO2 12C' being supplied to device 25' (not shown). In the operation of the low temperature refrigeration system, panel 66' causes compressor 122' to circulate a suitable freon type refrigerant, where it is first condensed by condenser 124' and thence by line 145 to suction heat exchanger 146 for cooling and thence to three way valve 148, set in this mode of operation to connect to line 180 and to sub-cooler 174. The sub-cooled freon type refrigerant next flows through line 150 to suction heat exchanger 152, where after further cooling, the refrigerant flows by line 154 to three-way 156 valve set in this mode, thence to expansion valve 158B, set for operation at about minus 65° F. The now expansion cooled refrigerant (a vapor-liquid mixture) flows through line 160 to evaporator 161 and then returns as vapor to compressor 122' after passing through exchangers 152 and 146 enroute. During this time, as controlled by sensor 181, pump 164 removes cold liquid CO2 (about minus 60° F.) from condenser 161 and thence to three way valve 166, set in this mode to return this cold liquid CO2 12C' to line 54' and thence to the lower portion of tank 24'. This arrangement allows the provision of liquid CO2 12C' from both that stored in tank 24' and that cooled by the low temperature refrigeration system. Should the amount needed increase, either the size of tank 24' can be increased (either by replacing with a larger unit or by adding another tank); or the size of the refrigeration unit increased (with the same type options). Again all as controlled by panel 66' so that the system may be operated as a low temperature process cooler and with the thermal storage capabilities of vessel 11' as previously described.

The operation of the invention as depicted in FIG. 7 is similar to that in FIG. 5 and with system 10' identical, except; a vapor compressor 182 with pressure control 183 has been added into line 142', line 168' connects to evaporator 161' instead of valve 166 (which is eliminated), a back pressure regulator 184 added in line 168' and level sensor 186 added to evaporator 161', all so that vapor 12B' can be removed from vessel 11', raised in pressure, condensed to liquid 12A' in evaporator 161' and returned to vessel 11' to either the upper portion (using line 171') or lower portion (using line 170') of vessel 11', as selected by the setting of three way valve 169' and all as controlled by panel 66'. This compressor arrangement provides both a means of increasing the refrigeration system's capacity by raising its evaporator temperature and/or lowering the pressure (and thus temperature) of the liquid 12A' in vessel 11', thereby increasing the thermal storage potential of liquid 12A' and decreasing the amount of cooling required for it to be cooled to the temperature of liquid 12C' (thereby increasing the entire capacity of system 10', beyond that previously), and very useful for those vessels 11' which are suitable for temperatures of about minus 40° F.

It should be understood that where the term "ground support" is used in the following claims it includes, but is not limited to, systems for filling small tanks with liquid CO2 carried on trucks, rail cars later or containers using CO2 for cooling, or filling dry ice bunkers on the same. The term "using device" (or substantially equal), is used, that term includes small tanks being filled with liquid CO2 for later use, as well as food freezers, food mixers, dry ice makers or systems for any CO2 using apparatus that perform better or more efficiently as to it's use of CO2, when supplied with deep cooled (below about minus 30° F.) or sub-cooled liquid CO2. The term "conduit" used in the following claims is to be interpreted broadly to include pipe, tube, valve, pump and other devices used for the transfer of fluid or vapor.

Likewise, the term "vessel" is to include tanks and other containers for liquids under pressure. In addition, the term "freon" is to include any low temperature freon, R-502, R-404A or other suitable low temperature refrigerant.

Although the invention has been described with regard to what is believed to be the preferred embodiment, changes and modifications as would be obvious to one having ordinary skill in both refrigeration and CO2 art can be made without departing from its scope. Particular features are emphasized in the claims that follow.

What is claimed is:

1. In a system for providing deep cooled and sub-cooled liquid carbon dioxide at various low temperatures and pressures to a using device utilizing liquid carbon dioxide for cooling, such as but not limited to trucks or rail cars or food freezers or mixers or dry ice producers, also known as a customer station or ground support/filling apparatus for refrigerated trucks or rail cars, which system comprises an insulated first vessel for receiving from a vehicle and storing liquid carbon dioxide for supply to, an insulated second vessel for receiving liquid carbon dioxide from said first vessel, then supplying for deep cooling and sub-cooling and then storing and then supplying the deep cooled and sub-cooled liquid carbon dioxide to a using device, first refrigeration means for cooling the liquid carbon dioxide stored in said first vessel, second refrigeration means for the deep cooling and sub-cooling of the liquid carbon dioxide in said second vessel to between about −30° F. and about −65° F. including means for rejecting at least some heat in the form of carbon dioxide vapor returned to said first vessel, conduit means for fluid or vapor carbon dioxide, the improvement comprising pressure management means in which as desired any rejected heat in the form of carbon dioxide vapor being returned to said first vessel is either cooled to its saturation temperature by liquid carbon dioxide from said first vessel without warming all the liquid carbon dioxide in said first vessel or as desired is cooled or condensed by warming all the liquid carbon dioxide in said first vessel, whereby as desired said first refrigeration means operates in a more efficient range, whereby as desired the bulk temperature of the liquid carbon dioxide stored in said first vessel and previously cooled by said first refrigeration means is not un-necessarily warmed by said rejected heat in the carbon dioxide vapor being returned to said first vessel and whereby as desired the liquid carbon dioxide stored in said first vessel acts as a thermal storage media for cooling or condensing said returned carbon dioxide vapor.

2. The apparatus according to claim 1 wherein said conduit means consists of first conduit means for supplying liquid carbon dioxide from said vehicle to said first vessel, second conduit means for supplying liquid carbon dioxide from a bottom portion of said first vessel to an upper portion of said second vessel and in a manner that deters mixing with the liquid carbon dioxide already there, third conduit means for supplying liquid carbon dioxide from an upper portion of said second vessel for said deep cooling by said second refrigeration means, fourth conduit means for returning the removed and deep cooled and sub-cooled liquid carbon dioxide by said second refrigeration means to a bottom portion of said second vessel and in a manner that deters mixing with the deep cooled and sub-cooled liquid carbon dioxide already there, fifth conduit means for returning said rejected heat carrying carbon dioxide vapor from said second refrigeration means to said first vessel and sixth conduit means for supplying cooled and sub-cooled liquid carbon dioxide to said device from a bottom portion of said second vessel and wherein said second vessel contains means for sensing the temperature of the carbon dioxide in the upper portion of said second vessel and control means, whereby when said second vessel is being supplied with liquid carbon dioxide, mixing of liquid carbon dioxide being supplied to said second vessel does not tend to mix with any deep cooled and sub-cooled carbon dioxide already within said second vessel, whereby when the deep cooled and sub-cooled liquid carbon dioxide is being returned to said second vessel from said refrigeration means, entry of the deep cooled and sub-cooled liquid carbon dioxide being returned to said second vessel does not tend to cause mixing of the deep cooled and sub-cooled carbon dioxide already within said second vessel with any warmer liquid carbon dioxide already there, whereby when said device is to be used, the total amount of deep cooled and sub-cooled liquid carbon dioxide available to said device is that within said second vessel and that deep cooled and sub-cooled by said second refrigeration means during the time of use of said device and whereby as desired said second refrigeration means operates to maintain the liquid carbon dioxide in said second vessel in the deep cooled and sub-cooled condition.

3. The apparatus according to claim 1 wherein seventh conduit means are provided to return the deep cooled and sub-cooled liquid carbon dioxide to said first vessel when desired, whereby the temperature of the liquid carbon dioxide stored in said first vessel is reduced so as to increase the capacity of said second refrigeration means when supplying said deep cooled and sub-cooled liquid carbon dioxide to said using device and whereby the thermal storage potential of the liquid carbon dioxide stored in said first vessel is increased.

4. The apparatus according to claim 1 wherein either said second conduit means or said sixth conduit means includes a liquid carbon dioxide pump to raise the pressure, or a pressure reducing valve to lower the pressure, of the liquid carbon dioxide in said first conduit means or of the deep cooled and sub-cooled liquid carbon dioxide in said fifth conduit means, whereby depending upon the manner in which said system is operated, deep cooled and sub-cooled liquid carbon dioxide can be supplied to said device at a selected temperature between about −30° F. and about −65° F. and at a selected pressure between about 65 psig and pressures as high as about 500 psig and above, so that the deep cooled and sub-cooled liquid carbon dioxide is at the optimus temperature and optimus pressure when being supplied to said device.

5. The apparatus according to claim 1 wherein said second refrigeration means depressurizes in one or more stages the liquid carbon dioxide being supplied from said second vessel so as to directly cause said deep cooling by evaporative cooling and includes a carbon dioxide compressor so as to return the resultant carbon dioxide vapor to said first vessel and includes a carbon dioxide pump to raise the pressure of the deep cooled liquid carbon dioxide before returning it to said second vessel, whereby the efficiencies of carbon dioxide as a working refrigerant for producing temperatures between about −30° F. and about −65° F. can be utilized and whereby deep cooled and sub-cooled liquid carbon dioxide can be produced.

6. The apparatus according to claim 1 wherein said second refrigeration means depressurizes a portion of the liquid carbon dioxide being supplied from said second vessel so as to indirectly cause by evaporative cooling and using a heat exchanger, thereby causes deep cooling of another portion of the liquid carbon dioxide supplied from said second vessel, and includes a carbon dioxide compressor so as to return the resultant carbon dioxide vapor to said first vessel and includes a carbon dioxide pump to return the deep cooled and sub-cooled liquid carbon dioxide to said second vessel, whereby the efficiencies of carbon dioxide as a working refrigerant for producing temperatures between about −30° F. and about −65° F. can be utilized and whereby deep cooled and sub-cooled liquid carbon dioxide can be produced.

7. The apparatus according to claim 1 wherein said second refrigeration means for deep cooling liquid carbon dioxide supplied from said second vessel is a freon type refrigerant mechanical refrigeration means and includes a freon compresser, a freon condenser, a liquid freon sub-cooler utilizing liquid carbon dioxide for the freon sub-cooling and a freon evaporator, whereby said second refrigeration means is able to operate efficiently for producing temperatures between about −30° F. and about −65° F. and whereby the efficiencies of using sub-cooled freon type refrigeration means may be realized.

8. The apparatus according to claim 1 wherein said second vessel or said second refrigeration means or said conduit means includes first separator means to remove any condensable contaminants carried in the liquid carbon dioxide and second separator means to remove any non-condensable contaminants released from the liquid carbon dioxide as a gas, whereby any condensable and non-condensable contaminants may be separated from the liquid carbon dioxide wherever they occur and before such contaminants interfere with the operation of said second vessel, said second refrigeration means, and any of said conduit means carrying deep cooled or deep cooled and sub-cooled liquid carbon dioxide or the operation of said second refrigeration means or the operation of said device.

9. In a system for providing deep cooled and sub-cooled liquid carbon dioxide at various low temperatures and pressures to a using device utilizing liquid carbon dioxide for cooling, such as but not limited to trucks or rail cars or food freezers or mixers or dry ice producers, added to an existing customer station, which consists of a liquid carbon dioxide storage vessel for receiving and storing liquid carbon dioxide from a vehicle, which system comprises, an insulated second vessel for receiving liquid carbon dioxide from said storage vessel, then supplying for deep cooling and sub-cooling and then storing and then supplying the deep cooled and sub-cooled liquid carbon dioxide to a using device, hybrid refrigeration means operable as desired in a first mode for cooling the liquid carbon dioxide in said storage vessel by removing carbon dioxide vapor therefrom and condensing it and returning it to said storage vessel, and alternately as desired in a second mode for deep cooling and sub-cooling the liquid carbon dioxide in said second vessel by removing it therefrom and cooling it to between about −30° F. and about −65° F. and returning it to said second vessel, compressor means to raise the pressure of carbon dioxide vapor removed from said storage vessel before condensing it by said refrigeration means when operating in said first mode and pressure control means so as to hold the vapor at the raised pressure while it is being condensed, pressure management means in which when said refrigeration means is operating in said first mode, carbon dioxide vapor removed from said storage vessel and condensed to liquid is returned, as desired, to either an upper or to a lower portion of said storage vessel and when said refrigeration means is operating in said second mode, rejected heat in the form of carbon dioxide vapor is either cooled to its saturation temperature by liquid carbon dioxide from said storage vessel without warming all the liquid carbon dioxide in said storage vessel or as desired is cooled or condensed by warming all the liquid carbon dioxide in said storage vessel, conduit means for liquid or vapor carbon dioxide, control means whereby said hybrid refrigeration means when operating in said first mode lowers the temperature of the liquid carbon dioxide stored in said storage vessel, whereby as desired the bulk temperature of the liquid carbon dioxide stored in said storage vessel and previously cooled by said hybrid refrigeration means, is not un-necessarily warmed by the returning carbon dioxide liquid or vapor before being supplied to said second vessel and whereby said hybrid refrigeration means when operating in said second mode operates in a more efficient range and whereby as desired liquid carbon dioxide stored in said storage vessel acts as a thermal storage media for cooling or condensing the returned carbon dioxide vapor when operating in said second mode.

10. The apparatus according to claim 9 wherein liquid carbon dioxide is delivered from the vehicle to the storage vessel in a cooled condition to below about −20° F., and first optional companion vessel refrigeration means and said second vessel are omitted and the second mode of said hybrid refrigeration means is optionally omitted, whereby as desired the ullage volume of said storage vessel acts as a receiver for carbon dioxide liquid said refrigeration means returns to said first vessel and whereby as desired the cooled liquid carbon dioxide delivered to and stored in said storage vessel is further cooled to between −30° F. and −65° F. by removal of vapor, then the vapor condensed by said refrigeration means operating in said first mode, and then returned to said storage vessel when as desired, in a manner that causes the stored and cooled liquid carbon dioxide to become sub-cooled by at least 5 psi before being supplied to said device.

11. In a system for providing deep cooled and sub-cooled liquid carbon dioxide at various low temperatures and pressures to a using device utilizing liquid carbon dioxide for cooling, such as but not limited to trucks or rail cars or food freezers or mixers or dry ice producers, also known as a customer station or ground support/filling apparatus for refrigerated trucks or rail cars, which system comprises an insulated first vessel for receiving from a vehicle and storing liquid carbon dioxide for supply to, an insulated second vessel for receiving liquid carbon dioxide from said first vessel, then supplying for deep cooling and sub-cooling and then storing and then supplying the deep cooled and sub-cooled liquid carbon dioxide to a using device, hybrid refrigeration means operable as desired in a first mode for cooling the liquid carbon dioxide in said first vessel and alternately as desired in a second mode for deep cooling and sub-cooling the liquid carbon dioxide in said second vessel to between about −30° F. and about −65° F., first conduit means for supplying carbon dioxide vapor from the ullage volume of said first vessel to said refrigeration means when operating in said first mode, second conduit means for returning carbon dioxide vapor in a condensed condition to said first vessel from said refrigeration means when operating in said first mode, third conduit means for supplying liquid carbon dioxide from said first vessel to said second vessel, fourth conduit means for supplying liquid carbon dioxide from-said second vessel to said refrigeration means when operating in said second mode, fifth conduit means for returning to said second vessel from said refrigeration means the deep cooled and sub-cooled liquid carbon dioxide when operating in said second mode, sixth conduit means for supplying deep cooled and sub-cooled liquid carbon dioxide from said second vessel to said device, whereby as desired said refrigeration means operates alternately in a first mode to provide or supplement the cooling of liquid carbon dioxide in said first vessel and alternately in a second mode to provide or supplement the deep cooling and sub-cooling of liquid carbon dioxide in said second vessel and whereby a single refrigeration means alternately performs, as desired, the functions of either of two.

12. The apparatus according to claim 11 wherein said refrigeration means when operating in the second mode includes means for rejecting at least some heat in the form of carbon dioxide vapor or warmed carbon dioxide liquid to said first vessel and seventh conduit means for returning said heat carrying carbon dioxide vapor or warmed liquid from said refrigeration means to a lower portion of said first vessel, whereby as desired liquid carbon dioxide stored in said first vessel acts as a thermal storage media and whereby said refrigeration means performs more efficiently when operating in the second mode.

13. The apparatus according to claim 11 wherein eight conduit means are provided to return the deep cooled or sub-cooled liquid carbon dioxide to said first vessel as desired, whereby the temperature of the liquid carbon dioxide stored in said first vessel can be reduced so as to increase the capacity of the system when operating in said second mode of supplying said deep cooled and sub-cooled liquid carbon dioxide to said device.

14. The apparatus according to claim 11 wherein when operating in said second mode, said third conduit means supplies said liquid carbon dioxide to an upper portion of said second vessel, said fourth conduit means supplies liquid carbon dioxide from an upper portion of said second vessel to said refrigeration means for deep cooling, said fifth conduit means returns the deep cooled and sub-cooled liquid carbon dioxide from said refrigeration means to a bottom portion of said second vessel and said seventh conduit means supplies, when needed, the cooled and sub-cooled liquid carbon dioxide to said device from a bottom portion of said second vessel all in a manner that mixing of the warmer liquid carbon dioxide entering said second vessel does not mix with the deep cooled and sub-cooled liquid carbon dioxide already there and wherein said second vessel contains means for sensing the temperature of the carbon dioxide in the upper portion of said second vessel and control means whereby when said device is in use, mixing of liquid carbon dioxide being supplied to said second vessel does not tend to mix with the deep cooled and sub-cooled carbon dioxide already within said second vessel, whereby when the deep cooled and sub-cooled liquid carbon dioxide is being returned to said second vessel from said refrigeration means, entry of the deep cooled and sub-cooled liquid carbon dioxide being returned to said second vessel does not tend to cause mixing of the deep cooled and sub-cooled carbon dioxide already within said second vessel with any warmer liquid carbon dioxide already there, whereby when said device is to be used, the total amount of deep cooled and sub-cooled liquid carbon dioxide available to said device is that within said second vessel and that deep cooled and sub-cooled by said second refrigeration means during the time of use of said device and, whereby said refrigeration means when in said second mode operates to maintain the liquid carbon dioxide in said second vessel in the deep cooled and sub-cooled condition.

15. The apparatus according to claim 11 wherein either said third conduit means or seventh conduit means includes a liquid carbon dioxide pump to raise the pressure, or a pressure reducing valve to lower the pressure, of the liquid carbon dioxide in said third conduit or of the deep cooled and sub-cooled liquid carbon dioxide in said seventh conduit means, whereby depending upon the manner in which said system is operated, deep cooled and sub-cooled liquid carbon dioxide can be supplied to said using device at a selected temperature between about −30° F. and about −65° F. and at a selected pressure between about 65 psig and pressures as high as about 500 psig and above, so that deep cooled and sub-cooled liquid carbon dioxide is at the optimus temperature and optimus pressure when being supplied to said device.

16. The apparatus according to claim 11 wherein said hybrid refrigeration means is a freon type refrigerant mechanical refrigeration means and includes a freon compressor, a freon condenser, and for when operating in the second mode for deep cooling and sub-cooling the liquid carbon dioxide removed from said second vessel, includes a liquid freon sub-cooler utilizing liquid carbon dioxide for the freon sub-cooling and a freon evaporator, whereby said refrigeration means is able to operate efficiently for producing temperatures of about 0° F. and also of between about −30° F. and about −65° F. and whereby the efficiencies of using freon and sub-cooled freon type refrigeration means may be realized.

17. The apparatus according to claim 11 wherein said second vessel or said refrigeration means or said fifth or sixth conduit means includes first separator means to remove any condensable contaminants carried in the liquid carbon dioxide and second separator means to remove any non-condensable contaminants released from the liquid carbon dioxide as a gas, whereby any condensable and non-condensable contaminants may be separated from the liquid carbon dioxide and before such contaminants interfere with the operation of said second vessel, said fifth or sixth conduit means carrying deep cooled and sub-cooled liquid carbon dioxide or the operation of said refrigeration means when operating in either said first mode or said second mode or the operation of said using device.

18. The apparatus according to claim 11 wherein a compressor is utilized to raise the pressure of said carbon dioxide vapor removed from said first vessel before condensing said vapor by said refrigeration means when operating in the said first mode, whereby the temperature and pressure of the liquid carbon dioxide stored in said first vessel is further reduced by said refrigeration means when operating in said first mode.

19. In a system for providing deep cooled or sub-cooled liquid carbon dioxide at various low temperatures and pressures to a using device utilizing liquid carbon dioxide for cooling, such as but not limited to trucks or rail cars or food freezers or mixers or dry ice producers, added to an existing customer station which consists of a liquid carbon dioxide storage vessel and optionally a companion vessel refrigeration means, which system comprises an insulated second vessel for receiving liquid carbon dioxide from said storage vessel, supplying for deep cooling and sub-cooling and then storing and then supplying the deep cooled and sub-cooled liquid carbon dioxide to a using device, hybrid refrigeration means for as desired in a first mode for cooling the liquid carbon dioxide stored in said storage vessel and alternately as desired in a second mode for deep cooling and sub-cooling the liquid carbon dioxide in said second vessel to between about −30° F. and about −65° F., first conduit means for supplying carbon dioxide vapor from the ullage volume of said first vessel to said refrigeration means when operating in said first mode, second conduit means for returning carbon dioxide vapor in a condensed condition to said storage vessel from said refrigeration means when operating in said first mode, third conduit means for supplying liquid carbon dioxide from said storage vessel to said second vessel, fourth conduit means for supplying liquid carbon dioxide from said second vessel to said refrigeration means when operating in said second mode, fifth conduit means for returning to said second vessel from said refrigeration means the removed and deep cooled and sub-cooled liquid carbon dioxide when operating in said second mode, sixth conduit means for supplying deep cooled and sub-cooled liquid carbon dioxide from said second vessel to said device, whereby as desired said refrigeration means operates alternately in a first mode to provide or supplement the cooling of liquid carbon dioxide in said storage vessel and alternately in a second mode to provide or supplement the deep cooling and sub-cooling of liquid carbon dioxide in said second vessel and whereby a single refrigeration means alternately performs, as desired, the function of either of two.

20. The apparatus according to claim 19 wherein said first conduit means supplies said liquid carbon dioxide to the upper portion of said second vessel, said second conduit means supplies cooled and sub-cooled liquid carbon dioxide to said using device from the lower portion of said second vessel, said third conduit means removes liquid carbon dioxide from the upper portion of said second vessel for said deep cooling, and said fifth conduit means returns said removed and deep cooled and sub-cooled liquid carbon dioxide to a bottom portion of said second vessel, whereby when said second vessel is being supplied with liquid carbon dioxide, mixing of liquid carbon dioxide being supplied to said second vessel does not tend to mix with any deep cooled and sub-cooled carbon dioxide already within said second vessel, whereby when the deep cooled and sub-cooled liquid carbon dioxide is being returned to said second vessel from said refrigeration means, entry of the deep cooled and sub-cooled liquid carbon dioxide being returned to said second vessel does not tend to cause mixing of the deep cooled and sub-cooled carbon dioxide already within said second vessel with any warmer liquid carbon dioxide already there and whereby when said device is to be used, the total amount of deep cooled and sub-cooled liquid carbon dioxide available to said device is that within said second vessel and that deep cooled and sub-cooled by said refrigeration means during the time of use of said device.

21. The apparatus according to claim 19 including wherein either said first conduit means or second conduit means includes a liquid carbon dioxide pump to raise the pressure, or a pressure reducing valve to lower the pressure, of liquid carbon dioxide in said first conduit or of deep cooled and sub-cooled liquid carbon dioxide in said second conduit means, whereby depending upon the manner in which said system is operated, deep cooled and sub-cooled liquid carbon dioxide can be supplied to said device at a selected temperature between about −30° F. and about −65° F. and at a selected pressure between about 65 psig and pressures as high as about 500 psig, so that deep cooled and sub-cooled liquid carbon dioxide is at the optimus temperature and optimus pressure when being supplied to said device.

22. The apparatus according to claim 19 wherein said hybrid refrigeration means is a freon type refrigerant mechanical refrigeration means and includes a freon compressor a freon condenser, and for when operating in the second mode for deep cooling the liquid carbon dioxide removed from said second vessel, includes a liquid freon sub-cooler utilizing liquid carbon dioxide for the freon sub-cooling and a freon evaporator, whereby said refrigeration means is able to operate efficiently in the second mode when producing temperatures between about −30° F. and about −65° F. and whereby the efficiencies of using sub-cooled freon type refrigeration means may be realized.

23. The apparatus according to claim 19 wherein said second vessel or said hybrid refrigeration means or said fourth or fifth conduit means includes first separator means to remove any condensable contaminants carried in the liquid carbon dioxide and second separator means to remove any non-condensable contaminants released from the liquid carbon dioxide as a gas, whereby any condensable and non-condensable contaminants may be separated from the liquid carbon dioxide wherever they occur and before such contaminants interfere with the operation of said second vessel, said fourth or fifth conduit means carrying deep cooled and sub-cooled liquid carbon dioxide or the operation of said refrigeration means or the operation of said device.

24. The apparatus according to claim 19 wherein a compressor is utilized to raise the pressure of said carbon dioxide vapor removed from said storage vessel before condensing said vapor with said refrigeration means when operating in said first mode, whereby the temperature and pressure of the liquid carbon dioxide stored in said storage vessel is further reduced by said refrigeration means, thereby increasing its thermal storage potential.

25. The apparatus according to claim 19 wherein liquid carbon dioxide is delivered from said vehicle to said first vessel in a cooled condition and first refrigeration means is optionally omitted, whereby as desired the cooled liquid carbon dioxide delivered to and stored in said first vessel acts as a thermal storage media for any said vapor returned to said first vessel from said second refrigeration means and whereby as desired the ullage volume of said first vessel acts as a receiver for said returned carbon dioxide vapor.

26. A method of receiving liquid carbon dioxide and deep cooling the liquid carbon dioxide to temperatures between about −30° F. and about −65° F. and storing the deep cooled liquid carbon dioxide in the sub-cooled condition for use with, but not limited to, a liquid carbon using device at a ground support/filling system for trucks or rail cars using liquid carbon dioxide for cooling, comprising the steps of:

receiving liquid carbon dioxide into a first insulated vessel and storing it therein, cooling said liquid carbon dioxide in said first vessel with a first refrigeration means, receiving said liquid carbon dioxide from said first vessel into the upper portion of a second insulated vessel and storing it therein, sensing the temperature of the liquid carbon dioxide in the upper portion of said second vessel, removing liquid carbon dioxide from an upper portion of said second vessel in response to said sensed temperature, deep cooling the removed liquid carbon dioxide with a second refrigeration means in a manner that creates at least some carbon dioxide vapor, returning said created carbon dioxide vapor to said first vessel is in a manner that as desired said vapor is cooled to its saturation temperature by liquid carbon dioxide from said first vessel without warming all the liquid carbon dioxide in said first vessel or as desired is cooled or condensed by warming all the liquid carbon dioxide in said first vessel, returning the removed liquid carbon dioxide to a lower portion of said second vessel in a deep cooled and sub-cooled condition and supplying the deep cooled and sub-cooled liquid carbon dioxide to a using device from a lower portion of said second vessel, whereby depending upon the manner in which said ground support system is operated, deep cooled and sub-cooled liquid carbon dioxide can be delivered at a selected temperature between about −30° F. and about −65° F. and at a pressure above about 65 psig, which pressure is at least about 5 psi above the equilibrium pressure for such selected temperature, so that cooled and sub-cooled liquid carbon dioxide at the optimus temperature, and at reduced carbon dioxide usage when used for cooling, for said device may be delivered therefrom, whereby the stored deep cooled and sub-cooled liquid carbon dioxide being supplied to said device from said second vessel can be supplied to said device simultaneously with said second refrigeration means replacing the deep cooled and sub-cooled liquid carbon dioxide supplied to said device without interfering with the supply of deep cooled and sub-cooled liquid carbon dioxide from said second vessel to said device, whereby the amount of deep cooled and sub-cooled carbon dioxide that can be supplied to said device within any time period is the total of that stored in said second vessel and that deep cooled and sub-cooled by said second refrigeration means during the time of use, whereby the thermal storage ability of said first vessel and its liquid carbon dioxide contents is increased for when second refrigeration means is deep cooling the liquid carbon dioxide and whereby the ability of the system to provide deep cooled and sub-cooled liquid carbon dioxide to said device is increased.

27. The method of claim 26 wherein supplying the cooling provided by said first refrigeration means and supplying the deep cooling provided by said second refrigeration means is by a third hybrid refrigeration means alternately as desired replacing said first refrigeration means or as desired replacing said second refrigeration means, whereby utilization of a single refrigeration means can be made by alternately performing either of two functions and whereby depending upon the manner in which said system is operated, deep cooled and sub-cooled liquid carbon dioxide can be supplied, at a selected temperature between about −30° F. and −65° F. and at a selected pressure as high as the MAWP of said first vessel, despite usage of liquid carbon dioxide from said first vessel, so that sub-cooled liquid carbon dioxide at the optimus temperature and pressure, and at reduced carbon dioxide usage, to said device.

* * * * *